US007650725B2

(12) United States Patent
Mead

(10) Patent No.: US 7,650,725 B2
(45) Date of Patent: Jan. 26, 2010

(54) FLOOR ACCESS PANEL WITH ELECTRICAL GROUNDING DEVICE

(75) Inventor: Bruce Mead, Mississauga (CA)

(73) Assignee: Kingspan Holdings (IRL) Ltd., Cavan (IE)

( * ) Notice: Subject to any disclaimer, the term of this patent is extended or adjusted under 35 U.S.C. 154(b) by 602 days.

(21) Appl. No.: 10/996,357

(22) Filed: Nov. 26, 2004

(65) Prior Publication Data

US 2005/0124190 A1 Jun. 9, 2005

(30) Foreign Application Priority Data

Dec. 4, 2003 (CA) ..... 2,452,038

(51) Int. Cl.
*E04B 5/14* (2006.01)

(52) U.S. Cl. ..... 52/263; 52/220.5; 174/5 SG; 439/108; 439/111; 439/884; 200/502

(58) Field of Classification Search ..... 52/263, 52/220.5, 769, 766, 773; 174/5 SG; 439/92, 439/108, 111, 884; 200/502
See application file for complete search history.

(56) References Cited

U.S. PATENT DOCUMENTS

| | | | | |
|---|---|---|---|---|
| 3,396,501 | A * | 8/1968 | Tate | 52/263 |
| 3,494,651 | A * | 2/1970 | Fork et al. | 52/220.5 |
| 4,085,557 | A | 4/1978 | Tharp | |
| 4,780,571 | A | 10/1988 | Huang | |
| 4,863,390 | A | 9/1989 | Cera et al. | |
| 4,976,627 | A | 12/1990 | O'Loughlin | |
| 5,057,647 | A | 10/1991 | Bogden et al. | |
| 5,081,696 | A * | 1/1992 | Beck | 174/5 SG |
| 5,179,810 | A * | 1/1993 | Gename et al. | 52/769 |
| 5,499,476 | A | 3/1996 | Adams | |
| 5,888,104 | A | 3/1999 | Mello et al. | |
| 5,953,870 | A | 9/1999 | Jette | |

* cited by examiner

*Primary Examiner*—Richard E Chilcot, Jr.
*Assistant Examiner*—Matthew J Smith
(74) *Attorney, Agent, or Firm*—Jacobson Holman PLLC

(57) ABSTRACT

A device for electrically grounding an access floor panel to a floor panel support in contact with a ground including a clip fastened to the floor panel, the clip compressible against the support when the floor panel is placed against the support.

14 Claims, 3 Drawing Sheets

FLOOR ACCESS PANEL WITH ELECTRICAL GROUNDING DEVICE

FIELD OF INVENTION

This invention relates generally to a device for electrically grounding an access floor panel and particularly relates to a deformable clip presented by said of said floor panel so as to make electrical contact with a support structure. The invention also relates to a method of grounding a floor panel in a grid defined by a plurality of stringers supported by a plurality of pedestals.

BACKGROUND OF THE INVENTION

Access floor systems or elevated floor structures have gained much popularity with the introduction of computer systems. These elevated floor structures comprise of floors constructed by arranging generally rectangular floor panels in side by side relation in a rectangular array. More particularly, the floor panels generally comprise a bottom surface spaced from a top surface so as to present four sides thereof. In one arrangement the top surface extends beyond the bottom surface so as to present a lip along each of the four sides which is adapted to being supported by stringers supported at the ends thereof by a plurality of pedestals defining a grid pattern. The floor panels can be individually removed for servicing.

Generally speaking, the access floor panels are required to have a generally low resistance or in other words a high conductivity between the top of the floor panel and the bottom of a pedestal which is generally supported by a building ground. In some applications the access floor panel is required to have an electrical resistance of less than 10 ohms when measured between the top of the bare panel i.e. the metallic surface and the bottom of the pedestal where it can be connected to a building ground. In other applications, the resistance must fall within the range of one to less than 10 ohms.

In order to accomplish such high conductivity the solutions ranging to date and the prior art include having a spring clip which are mounted to the stringer to make electrical contact to the floor panel. However, the floor panel is generally painted, and the paint is a poor conductor thus increasing the resistance. In other applications, brass strips are laminated between the laminate top of the top surface of the floor panel and the bare panel. Such remedies are sometimes ineffective as the panel paint must be scratched and the brass strips must touch the stringers.

Furthermore, other arrangements are shown in U.S. Pat. No. 5,888,104 which relates to an electrical grounding connector comprising a U-bolt, a upper clamp part and a lower clamp part. The upper clamp part is connected to the U-bolt, to clamp a floor pedestal there between.

Furthermore U.S. Pat. No. 4,976,627 illustrates an electrical connector for mechanically and electrically connecting conductors.

Furthermore U.S. Pat. No. 4,780,571 relates to a combined floor pedestal and floor outlets which include a base drum and a support drum and are interconnected by an adjustment sleeve member which is sleeved around and threadedly connected to the base drum and support drum. The assembly is convenient for making height adjustments as well as electrical connection.

It is an object of this invention to provide an improved device where electrically grounding an access floor panel to a floor panel support. It is the further object of this invention to provide an improved method of grounding a floor panel in a grid defined by a plurality of stringers supported by a plurality of pedestals.

It is an aspect of this invention to provide a device for electrically grounding an access floor panel to a floor panel support comprising a clip fastened to the floor panel, the clip compressible against the support when the floor panel is placed against the support.

It is another aspect of this invention to provide a floor panel for a raised access floor defined by a plurality of floor panels each supported by a grid of horizontally disposed stringers, the stringers are supported at the ends thereof by a plurality of pedestals respectively, the floor panel having a rectangular bottom surface and a rectangular top surface spaced from said bottom surface by four sides thereof, said top surface extending beyond said bottom surface to define a lip along four sides thereof, each said lip adapted to be supported by one of said stringers, where one of said sides includes a recess adapted to receive a spring clip adapted to spring against said stringer when said floor panel is supported by said stringer of said grid.

It is yet another aspect of this invention to provide a method of grounding a floor panel in a grid defined by a plurality of stringers supported by a plurality of pedestals comprising the steps of; electrically fastening a deformable metal clip to one side of said floor panel; placing said floor panel into said grid so as to support said floor panel on said stringers compressing said spring against said stringer so as to make electrical contact thereto.

These and other objects and features of the invention shall be described in relation to the following drawings.

BEST MODE FOR CARRYING OUT THE INVENTION

Figure 1:
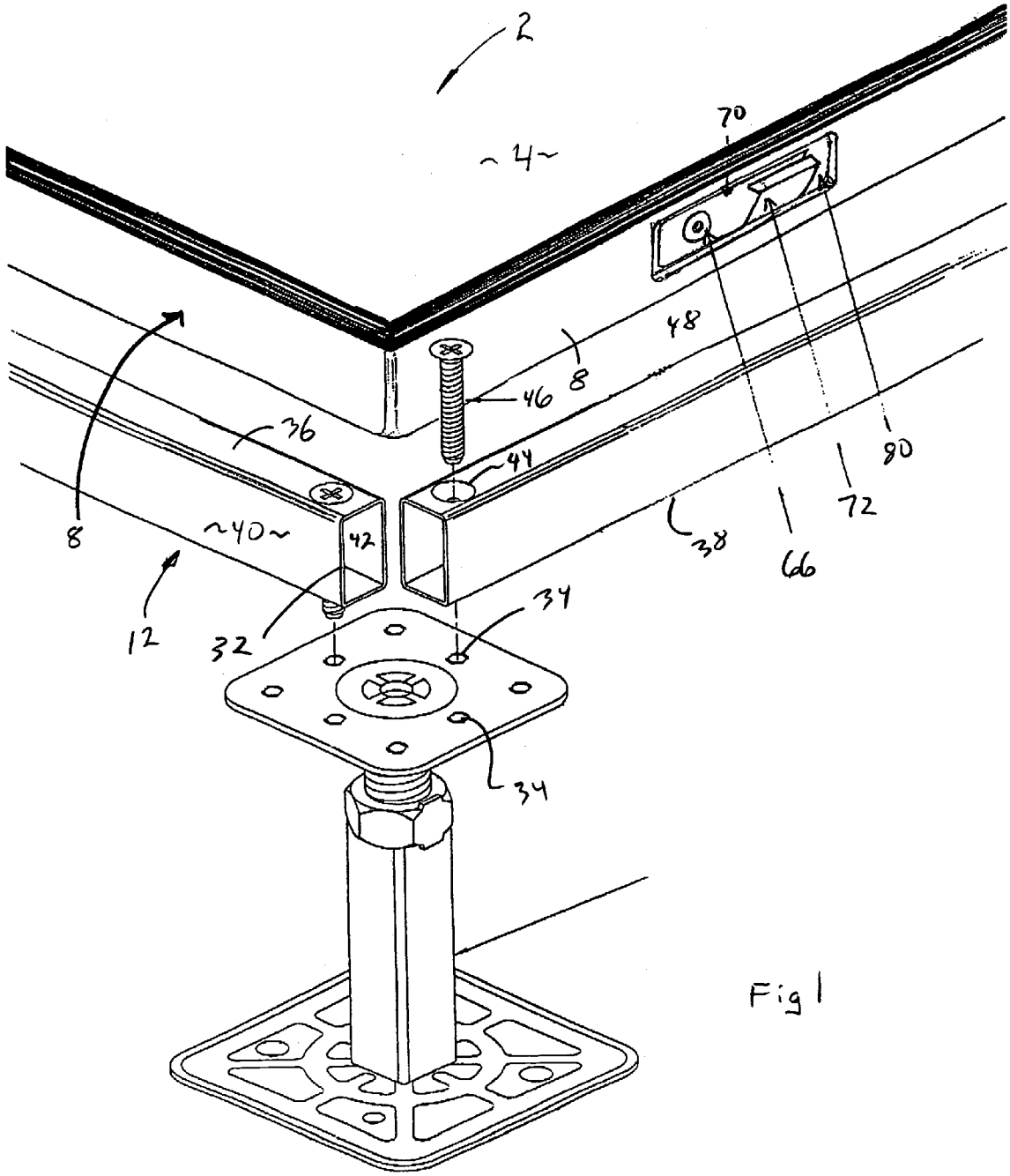
FIG. 1 is a perspective view of the device for electrically grounding access floor panel.

In the description which follows, like parts are marked throughout the specification and the drawings with the same respective reference numerals. The drawings are not necessarily to scale and in some instances proportions may have been exaggerated in order to more clearly depict certain features of the invention.

FIG. 1 generally illustrates an access floor panel 2 having a top surface 4 space from a bottom surface 6. The access floor panel 2 can have a variety of configurations and in one embodiment is rectangular (not shown) having four sides 8. In another embodiment the panels can be square (not shown).

Figure 5:
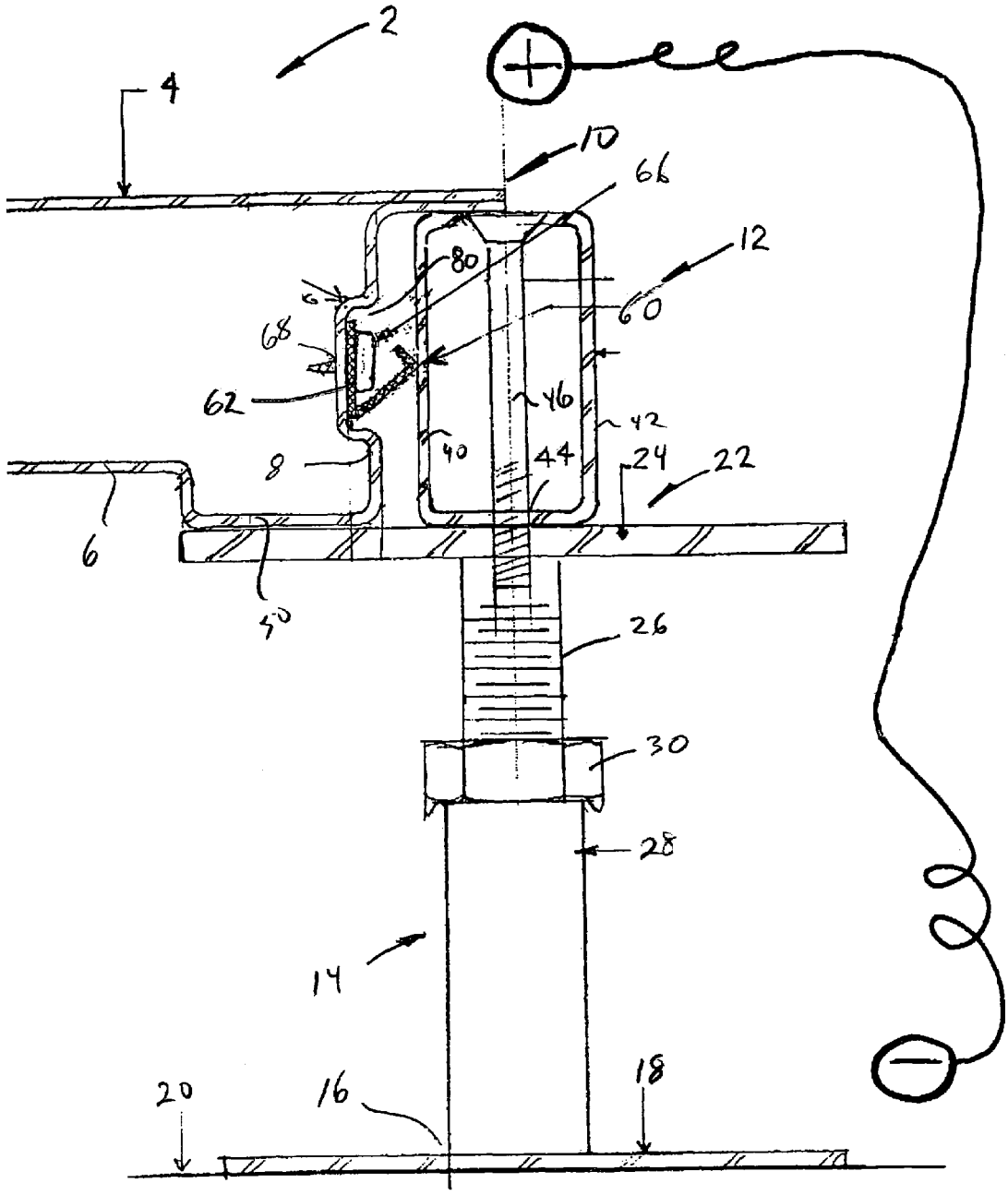
FIG. 5 is a vertical cross sectional view to a floor panel and stringer and pedestal.

As best seen in FIG. 5, the top surface 4 extends beyond the bottom surface so as to define a lip 10 which is adapted to be supported on a stringer 12. The stringer 12 is supported at the ends thereof on a pedestal 14 at each end.

The pedestal 14 includes at its lower end thereof 16 a base 18 which is adapted to contact the ground 20 such as the ground presented by a building ground.

The pedestal 14 includes at the top end thereof 22 a flat head assembly 24 which is adapted to support the stringer 12. The pedestal 14 has means of adjusting the height or distance between the head assembly 24 from the base assembly 18 by means of rotating the threaded shaft 26 about the pedestal column 28 in a manner well known to those persons skilled in the art. Once the desired height is reached, the nut 30 tightens the shaft 26 to the pedestal column 28 in a manner well known to those persons skilled in the art.

The pedestals are arranged in a manner well known to those persons skilled in the art in a grid pattern. Thereafter, stringers 12 are disposed substantially horizontally between adjacent pedestals 14 such that the ends 32 of the pedestal overlap and are supported by the head assembly 24. In particular, the head assemblies 24 include a plurality of threaded holes 34 which align with holes 44 located in the ends 32 of the stringers 12.

The stringer 12 in one embodiment is generally hollow and tubular in structure having a stringer top surface 36 spaced from a stringer bottom surface 38. Furthermore, the stringer has spaced vertically disposed sidewalls 40 and 42 as shown. The top and bottom stringer surfaces 36 and 38 include aligned holes 44 which are adapted to receive screws 46 adapted to be screwed and fastened to the threaded holes 34 of the pedestal. In this manner, the horizontally disposed stringers define a grid structure well known to those persons in the art. The grid structure includes grid openings 48 adapted to receive the access floor panel 2 as best illustrated in FIG. 1. The screws 46 have a head which is counter sunk so as to lie flush with the stringer top surface 36 as best seen in FIG. 1. Thereafter the lip on all four sides of the access floor panel 2 is supported on the top surface 36 of the stringer 12.

The access floor panel 2 can be constructed in a variety of ways well known to those persons in the art and in the embodiment shown in FIG. 5 comprises of a formed sheet of metal which includes a bottom surface 6. The bottom surface 6 is bent or formed so as to produce a bottom support adapted to contact the head assembly 24 which in turn is formed or bent to produce the sides 8 as previously described. The sides 8 continue upwardly and outwardly so as to merge with the top surface 4 and define the lip 10 as best seen in FIG. 5. Other constructions however are possible, including other configurations whether square, hexagonal, or rectangle panel.

A deformable means 60 is presented by the access floor panel and adapted to contact one of the sides 40, 42 of the stringer 12 so as to provide good electrical contact. In particular the deformable means comprises a clip 62 which is compressible against the support when the floor panel is placed against the support.

The clip 62 includes an aperture 64 adapted to receive a fastener such as a screw 66 through a hole 68 presented by the sidewall 8. The clip 62 is made of metal or other electrical conductors such as brass, bronze, copper, aluminum or the like. Since the hole 68 presents a bare metal surface to the screw 66 good electrical conductivity is presented between the top surface 4, sides 8, screw 66 and spring 60. The stringers 12 thread to the fastener 46, threaded member 26, support 28 and base assembly 18 are also metal so as to provide good electrical conductivity between top surface 4 and bottom 16 of pedestal 4.

Figure 2:
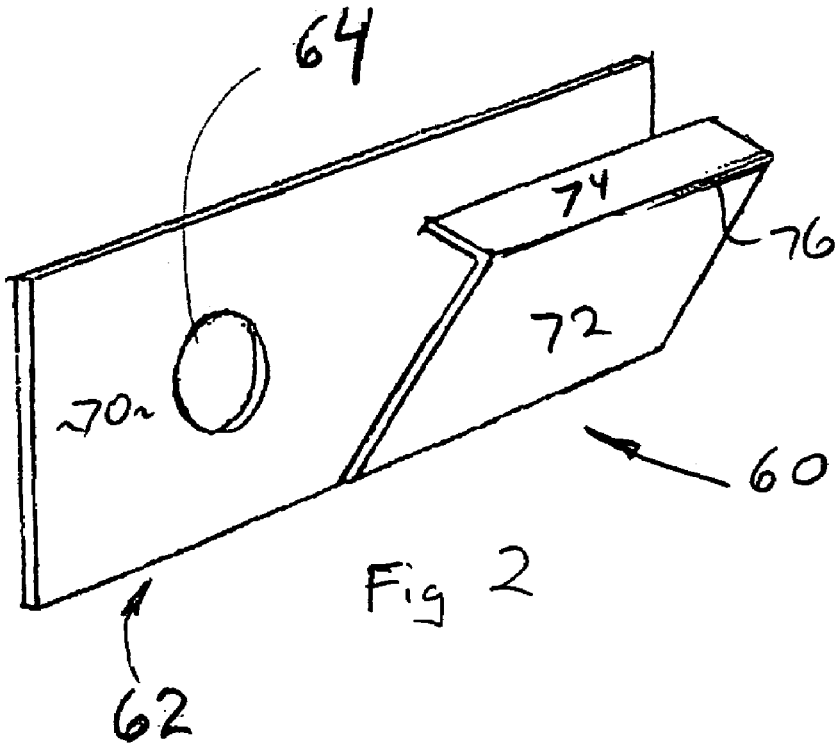
FIG. 2 is a perspective view of a clip.
Figure 3:
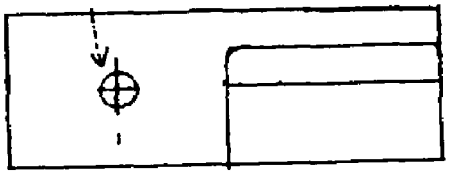
FIG. 3 is a top plan view of FIG. 2.

The clip 62 includes a back portion 70 and a V-shaped leg 72 disposed vertically upwardly from the bottom edge of the back portion 70 as best seen in FIG. 2. Furthermore the leg 72 includes an inward portion 74 so as to present a contact surface 76 to contact one of the sides 40 of the stringer 12.

Figure 4:
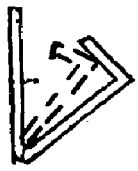
FIG. 4 is a side elevational view of FIG. 2.

When the access floor panel 2 is pulled away from the grid the clip 62 presents the contact 76 in its outermost position as shown in FIG. 4. Once the access floor panel 2 is dropped into the opening 48 of the grid system the contact 76 is pushed inwardly and assumes the position shown in FIG. 5 as well as the position shown in dotted lines of FIG. 4. In other words the clip 62 springs inwardly or is deformed inwardly and presents a contact surface 76 which is urged against the sides of the stringer 12 to produce good electrical contact. Furthermore as the access floor panel 2 is removed from the grid structure, the clip 62 will spring back to the position shown in FIG. 4 without being caught by the stringer 12.

Any shape of clip 62 can be used such as a curved leaf (not shown) or other shape within in the spirit of this invention so long as the clip 62 springs against the stringer 12 in a manner described.

In another embodiment the access floor panel 2 has at least one side which presents a recessed area 80 which is adapted to receive the clip 62. The recessed area 80 includes the holes 68 for fastening the clip 62 to the side 8. The recessed area 80 protects the clip 62 from accidental damage. Furthermore the clip 62 is disposed in the recessed area 80.

The grid pattern comprises a plurality of pedestals appropriately spaced to support the stringers 12.

The structure defined herein has exhibited electrical resistance of the top surface 4 of the floor panel 2 of in one example of less than 10 ohms to the bottom of the pedestal 16.

The invention as described includes a device for electrically grounding an access floor panel 2 to a floor panel support which comprises a clip 62 fastened to the floor panel where the clip is compressible against the support when the floor panel is placed against the support.

Moreover the invention describes a floor panel 2 for a raised access floor defined by a plurality of floor panels 2 supported by a grid of horizontally disposed stringers 12, each stringer supported at the ends thereof by two spaced apart pedestals 14; where the floor panel has a rectangular bottom surface 6 and a rectangular top surface 4 spaced from the bottom surface 6 by four sides 8 thereof where the top surface 4 extends beyond the bottom surface 6 to define a lip 10 where the lip 10 is adapted to be supported by one of the stringers 12. One of the sides 8 includes a recess 80 adapted to receive a spring clip 62 adapted to spring against the stringer 12 when the floor panel 2 is supported by the stringer 12 in the grid. At least one side 8 of the access floor panel 2 includes the clip 62. However two or three or all sides 8 of the access floor panel 2 can include the clip 62.

The clip 62 is bent to permit the floor panel 2 to be dropped into the grid so as to be horizontally supported by the stringers 12 and to compress said clip against a side 40 of the stringer 12 to make electrical contact with the stringer 12 into pedestal 14.

The invention described herein shows a clip 62 which is mechanically fastened to a positive connection of less resistance. The recessed area 80 is deep enough to allow for a head of a fastener 66 to be spaced from side 40 of the stringer 12 so as to permit the spring action of the clip 62 as described with the proper clearance between the panel 2 and the stringer 12.

The brass, bronze, copper or aluminum spring 62 is fastened to the panel 2 and is shaped to allow the panel 2 to be dropped into the access floor grid. When a panel is dropped into the grid the clip or spring 62 is compressed making a positive electrical contact with the stringer. The stringer 12 is mechanically connected to the pedestal 14 where grounding occurs.

The upper portion of the clip 62 is shaped and formed so it can be removed when the panel 2 is lifted out without deformation or damage of its shape in future use.

The stringer 12 and pedestal 14 can be made of a raw metal or coated with a conductive finish.

The invention also describes a method of grounding a floor panel in a grid defined by a plurality of stringers 12 and supported by a plurality of pedestal 14 comprising the steps of fastening the deformable metal clip 62 to one side 8 of the floor panel 2, and placing the floor panel 2 into said grid so as to support said floor panel 2 on the stringers 14 and compressing said metal clip 62 against the stringer 12 so as to make electrical contact thereto.

Although the preferred embodiment as well as the operation and the use have been specifically described in relation to the drawings, it should be understood the variations and the preferred embodiment could be achieved by a person skilled in the art without departing from the spirit of the invention as claimed herein.

Various embodiments of the invention have now been described in detail. Since changes in and/or additions to the above-described best mode may be made without departing from the nature, spirit or scope of the invention, the invention is not to be limited to said details.

I claim:

1. A device for electrically grounding an access floor panel to a floor panel support in contact with a ground comprising a clip fastened to said floor panel, said clip being compressible against said support when said floor panel is placed against said support;

said clip including an aperture adapted to receive a screw for electrically fastening said clip to said access floor panel;

said clip being bent and springs against said support when said floor panel is placed against said support, said support including substantially horizontally disposed stringers, said stringer being supported by a pedestal at each end thereof;

said floor panel including a top, bottom and sides;

said clip being disposed along one of said sides of said floor panel.

2. A device as claimed in claim 1 where one of said sides of said floor panels includes a recessed area, and said clip is disposed in said recessed area.

3. A device as claimed in claim 2 wherein said stringer includes a top, bottom and two vertically spaced sides.

4. A device as claimed in claim 3 wherein said clip springs against one of said sides of said stringer.

5. A device as claimed in claim 4 wherein said pedestal includes a top supporting said end of said stringer and a bottom contacting said ground.

6. A device as claimed in claim 5 wherein the said floor panel exhibits an electrical resistance of less then 10 ohms between the top of said floor panel and said bottom of said pedestal.

7. A floor panel for a raised access floor defined by a plurality of said floor panels supported by a grid of horizontally disposed stringers wherein each said stringer is supported at the ends thereof by two spaced apart pedestals respectively; each of said floor panels comprising a rectangular bottom surface, and a rectangular top surface spaced from said bottom surface by four sides thereof, said top surface extending beyond said bottom surface to define a lip along each of said sides, each said lip adapted to be supported by one of said stringers of said grid, one of said sides of said floor panel including a recess adapted to receive a spring clip for springing against said stringer when said floor panel is supported by said stringers.

8. A floor panel as claimed in claim 7 wherein said clip is bent to permit said floor panel to be dropped into said grid to be horizontally supported by said stringers, and to compress said clip against a side of said stringer to make electrical contact with said stringer and said pedestal.

9. A floor panel as claimed in claim 8 wherein said clip, stringers and pedestals are comprised of metal to make electrical contact between said top of said floor panel, and bottom of said pedestal to said ground.

10. A floor panel as claimed in claim 9 wherein the resistance between said top of said floor panel and bottom of said pedestal is less than 10 ohms.

11. A method of grounding a floor panel in a grid defined by a plurality of horizontally disposed stringers supported by a plurality of pedestals comprising the steps of:

(a) fastening a deformable metal strip to one side of said floor panel;

(b) placing said floor panel into said grid so as to support said floor panel on said stringers; and (c) compressing said metal clip against said stringer so as to make an electrical contact thereto.

12. A method as claimed in claim 11 including the step of forming a recess in one of said sides in said floor panel and electrically fastening said clip within said recess.

13. A method as claimed in claim 12 wherein said clip is moveable to its original shape upon removal of said floor panel from said grid.

14. A method as claimed in claim 13 wherein the said clip is fastened into said recess.

* * * * *

UNITED STATES PATENT AND TRADEMARK OFFICE

CERTIFICATE OF CORRECTION

PATENT NO. : 7,650,725 B2
APPLICATION NO. : 10/996357
DATED : January 26, 2010
INVENTOR(S) : Bruce Mead It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1259 days.

Signed and Sealed this

Twenty-third Day of November, 2010

David J. Kappos

David J. Kappos
*Director of the United States Patent and Trademark Office*